US011042111B2

(12) United States Patent
Takenaka

(10) Patent No.: US 11,042,111 B2
(45) **Date of Patent: *Jun. 22, 2021**

(54) INFORMATION PROCESSING APPARATUS, INFORMATION PROCESSING SYSTEM, AND IMAGE FORMING APPARATUS

(71) Applicant: TOSHIBA TEC KABUSHIKI KAISHA, Tokyo (JP)

(72) Inventor: Sunao Takenaka, Odawara Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/875,394

(22) Filed: May 15, 2020

(65) Prior Publication Data

US 2020/0278633 A1 Sep. 3, 2020

Related U.S. Application Data

(63) Continuation of application No. 16/567,941, filed on Sep. 11, 2019, now Pat. No. 10,691,054.

(30) Foreign Application Priority Data

Dec. 25, 2018 (JP) ..... JP2018-241684

(51) Int. Cl.
*G03G 15/08* (2006.01)
*G03G 15/00* (2006.01)
*G03G 21/18* (2006.01)

(52) U.S. Cl.
CPC ..... *G03G 15/553* (2013.01); *G03G 15/0856* (2013.01); *G03G 15/5079* (2013.01); *G03G 21/181* (2013.01); *G03G 21/1814* (2013.01)

(58) Field of Classification Search
CPC ..... G03G 15/553; G03G 15/0856; G03G 15/5079; G03G 21/181; G03G 21/1814
See application file for complete search history.

(56) References Cited

U.S. PATENT DOCUMENTS

2006/0018674 A1 1/2006 Hirata et al.
2011/0091224 A1 4/2011 Takenaka

FOREIGN PATENT DOCUMENTS

JP 2003-186652 A 7/2003

*Primary Examiner* — Hoang X Ngo
(74) *Attorney, Agent, or Firm* — Kim & Stewart LLP

(57) ABSTRACT

According to an embodiment, an information processing apparatus includes a communication device and a processor. The processor collects information from a plurality of apparatuses via the communication device. The processor derives a formula on a basis of the collected information, the formula defining a relationship between a value about use of the component or the consumable item and a value about physical property of the component or the consumable item.

10 Claims, 9 Drawing Sheets

204

| | $X_1$ | $X_2$ | $X_3$ | Y |
|---|---|---|---|---|
| | TEMPERATURE (°C) | HUMIDITY (%RH) | DRIVING ROTATION NUMBER | RESISTANCE DETECTED VALUE (Log Ω) |
| MACHINE 1 | 24 | 56 | 625837 | 7.62 |
| MACHINE 2 | 25 | 13 | 533394 | 7.54 |
| MACHINE 3 | 24 | 22 | 1251256 | 7.68 |
| ... | ... | ... | ... | ... |
| MACHINE 100 | 30 | 64 | 1429971 | 7.17 |

Fig.5

INFORMATION PROCESSING APPARATUS, INFORMATION PROCESSING SYSTEM, AND IMAGE FORMING APPARATUS

CROSS-REFERENCE TO RELATED APPLICATIONS

This application is a continuation of U.S. patent application Ser. No. 16/567,941, filed on Sep. 11, 2019, which is based upon and claims the benefit of priority from the prior Japanese Patent Application No. 2018-241684, filed on Dec. 25, 2018, the entire contents of which are incorporated herein by reference.

FIELD

An embodiment described here generally relates to an information processing apparatus, an information processing system, and an image forming apparatus.

BACKGROUND

An image forming apparatus such as an MFP (Multi-Function Peripheral) has a plurality of components and a plurality of consumable items. The physical property of each component changes depending on a use status each component. The same applies to the physical property of a consumable item.

A transfer apparatus is an example of a component of an MFP. The transfer apparatus includes a transfer roller pair. Recently, a conductive sponge rubber roller pair is mainly used as a transfer roller pair. Even if the transfer roller pair operates in a normal situation, the electric resistance of the transfer roller pair increases as the use time period increases. Finally, the transfer bias reaches the transformer permissible voltage maximum value, and the transfer roller pair cannot apply a current necessary to transfer and reaches the end of the lifetime. As described above, even if the transfer roller pair operates in a normal situation, the transfer roller pair reaches the end of the lifetime as the electric resistance increases.

Meanwhile, even before the transfer roller pair reaches the end of the lifetime in a normal operational situation, the electric resistance of the transfer roller pair may increase if a failure occurs in a component of the transfer apparatus. If the transfer roller pair itself is broken or a power source is broken, the transfer roller pair cannot transfer paper normally. Further, if a bearing of the transfer roller pair is broken, the transfer roller pair cannot come to close contact with a transfer belt.

When the transfer roller pair reaches the end of the lifetime in a normal operational situation, it is necessary to replace the transfer roller pair. The MFP cannot execute printing until a service person replaces the transfer roller pair. So, if it is possible to predict the lifetime of the transfer roller pair, the MFP may execute an action for reducing downtime in advance such as output of an alert or execute a life-prolonging action, with which it is possible to use the MFP for a while after the transfer roller pair reaches the end of the lifetime.

Meanwhile, if any failure occurs in the transfer apparatus, a component of the transfer apparatus may be about to be broken critically. In view of that, if it is possible to determine whether or not there is a failure in a component of the transfer apparatus, a user may stop the operation of the MFP and call a service person.

However, even if a transfer roller pair operates in a normal situation, the electric resistance of transfer roller pair largely varies depending on a lifespan (aging or aging degree) of the transfer roller pair or a use status such as a use environment. Further, the electric resistance of the transfer roller pair largely varies also when the transfer roller pair itself is broken or a component relating to the transfer roller pair is broken. Because of that, an MFP cannot predict a lifetime of a transfer roller pair or cannot determine whether or not there is a failure in a transfer apparatus including the transfer roller pair only on a basis of the electric resistance of the transfer roller pair.

BRIEF DESCRIPTION OF THE DRAWINGS

FIG. 5 is a diagram showing an example of a storage device that stores information collected by a server according to the present embodiment.

DETAILED DESCRIPTION

According to an embodiment, an information processing apparatus is configured to manage information of a plurality of apparatuses, the plurality of apparatuses being configured to be connected to the information processing apparatus via a network. The information processing apparatus includes a communication device, a storage device, and a processor. The communication device is configured to communicate with the plurality of apparatuses via the network. The storage device is configured to store a first detected value about physical property of a component or a consumable item that each of the plurality of apparatuses has, which changes depending on a use status, and a second detected value about use of the component or the consumable item. The processor is configured to collect the first detected value and the second detected value about each of the plurality of apparatuses via the communication device. The processor is configured to cause the storage device to store the collected first detected value and the collected second detected value for each of the plurality of apparatuses. The processor is further configured to derive a formula on a basis of the stored first detected value and the stored second detected value, the formula defining a relationship between a value about use of the component or the consumable item and a value about physical property of the component or the consumable item.

Figure 1:
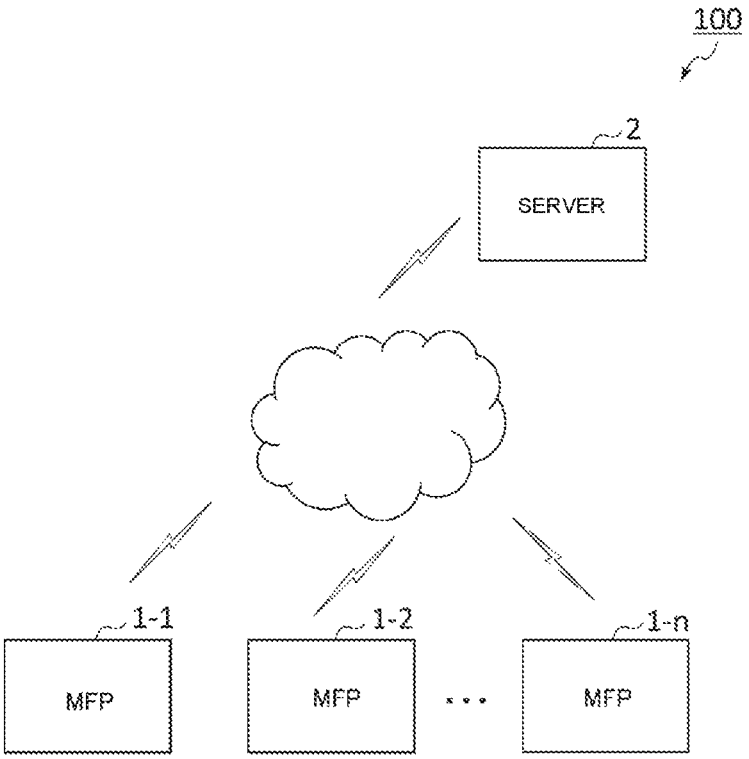
FIG. 1 is a diagram schematically showing an example of an information processing system according to an embodiment.

Hereinafter, an embodiment will be described with reference to the drawings. In the drawings, the same reference symbols indicate the same or similar units. FIG. 1 is a diagram schematically showing an example of the information processing system 100.

The information processing system 100 includes the plurality of MFP 1-1, MFP 1-2, . . . and, MFP **1-*n* (n is 2 or more), and the server 2. Each of the plurality of MFPs 1-1 to 1-*n* and the server 2** are connected to each other such that they are capable of communicating with each other via a network. For example, the network is the Internet, but is not limited to this.

A structure of the MFP 1-1 will be described. The MFP 1-1 is an example of an image forming apparatus using the electrophotographic technology. Note that a structure of each of the MFPs 1-2 to **1-*n* is similar to the structure of the MFP 1-1**, and thus description thereof will be omitted.

Figure 2:
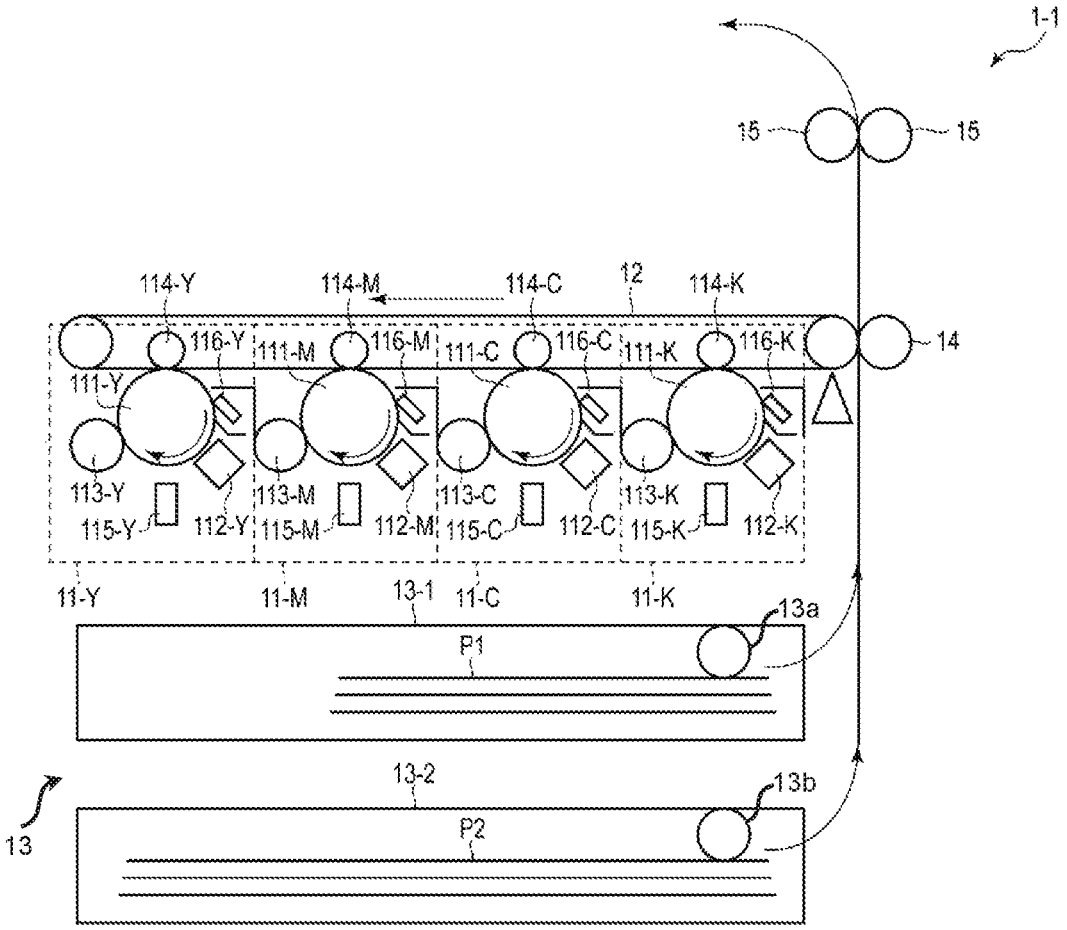
FIG. 2 is a sectional view showing an example of an MFP according to the present embodiment.

FIG. 2 is a sectional view showing an example of the MFP 1-1. The MFP 1-1 includes the image forming units 11-Y, 11-M, 11-C, and 11-K, the transfer belt 12, the paper feeder device 13, the secondary transfer roller pair 14, and the fuser roller pair 15.

The image forming unit 11-Y is a unit that forms a yellow (Y) toner image, and transfers the yellow (Y) toner image to the transfer belt 12. The image forming unit 11-M is a unit that forms a magenta (M) toner image, and transfers the magenta (M) toner image to the transfer belt 12. The image forming unit 11-C is a unit that forms a cyan (C) toner image, and transfers the cyan (C) toner image to the transfer belt 12. The image forming unit 11-K is a unit that forms a black (K) toner image, and transfers the black (K) toner image to the transfer belt 12. As a result, the MFP 1-1 forms a full-color image on the transfer belt 12.

The image forming unit 11-Y includes the photosensitive drum 111-Y, the charger 112-Y, the developer 113-Y, the primary transfer roller 114-Y, the exposure device 115-Y, and the cleaner 116-Y. The aforementioned respective devices 112-Y, 114-Y, 115-Y, and 116-Y are arranged around the photosensitive drum 111-Y. Each of the image forming units 11-M, 11-C, and 11-K has a structure similar to the structure of the image forming unit 11-Y except that each image forming unit includes a photosensitive drum, a developer, and an exposure device for forming a toner image of a dedicated color.

Note that, in FIG. 2, the image forming unit 11-Y for forming a yellow (Y) toner image is denoted by the reference symbol "-Y". The image forming unit 11-M for forming a magenta (M) toner image is denoted by the reference symbol "-M". The image forming unit 11-C for forming a cyan (C) toner image is denoted by the reference symbol "-C". The image forming unit 11-K for forming a black (K) toner image is denoted by the reference symbol "-K".

The chargers 112-Y, 112-M, 112-C, and 112-K uniformly charge the photosensitive drums 111-Y, 111-M, 111-C, and 111-K, respectively. The exposure devices 115-Y, 115-M, 115-C, and 115-K includes light-emitting devices, respectively. The exposure devices 115-Y, 115-M, 115-C, and 115-K expose the photosensitive drums 111-Y, 111-M, 111-C, and 111-K to light on a basis of image data (described below). The exposure devices 115-Y, 115-M, 115-C, and 115-K form electrostatic latent images having dedicated image-forming colors on the photosensitive drums 111-Y, 111-M, 111-C, and 111-K, respectively, by exposing the photosensitive drums to light as described above. The developer 113-Y attaches yellow toner onto the electrostatic latent image on the photosensitive drum 111-Y and develops the electrostatic latent image to thereby form a yellow toner image on the photosensitive drum 111-Y. The developer 113-M attaches magenta toner onto the electrostatic latent image on the photosensitive drum 111-M and develops the electrostatic latent image to thereby form a magenta toner image on the photosensitive drum 111-M. The developer 113-C attaches cyan toner onto the electrostatic latent image on the photosensitive drum 111-C and develops the electrostatic latent image to thereby form a cyan toner image on the photosensitive drum 111-C. The developer 113-K attaches black toner onto the electrostatic latent image on the photosensitive drum 111-K and develops the electrostatic latent image to thereby form a black toner image on the photosensitive drum 111-K.

The primary transfer rollers 114-Y, 114-M, 114-C, and 114-K transfer the toner images developed and formed on the photosensitive drums 111-Y, 111-M, 111-C, and 111-K as described above to the transfer belt 12. The cleaners 116-Y, 116-M, 116-C, and 116-K remove remaining untransferred toner from the photosensitive drums 111-Y, 111-M, 111-C, and 111-K to thereby clean the photosensitive drums. Then the photosensitive drums 111-Y, 111-M, 111-C, and 111-K stand by for the next image forming.

Note that the image forming unit 11-Y may have a structure different from the aforementioned structure. For example, the image forming unit 11-Y may include a discharger for discharging the photosensitive drums 111-Y, 111-M, 111-C, and 111-K after the aforementioned cleaning. The same applies to the image forming unit 11-M, the image forming unit 11-C, and the image forming unit 11-K.

The paper feeder device 13 includes the paper cassettes 13-1 and 13-2, and the paper feeder rollers **13*a* and 13*b*. The paper cassette 13-1 accommodates the paper P1 having a first size (small size). The paper cassette 13-2 accommodates the paper P2 having a second size (large size) different from the aforementioned first size. The paper feeder rollers 13*a* and 13*b* take the paper P1 and P2 out from the paper cassettes 13-1 and 13-2, respectively, and supply the paper to a transfer position, at which the transfer belt 12 faces the secondary transfer roller pair 14. The secondary transfer roller pair is arranged at the transfer position such that the transfer roller pair 14 faces the transfer belt 12. The secondary transfer roller pair 14 causes the paper P1 or P2, which is supplied from the paper feeder device 13, to come to close contact with the transfer belt 12, on which a toner image is transferred. As a result, the toner image is transferred onto the paper P1 or P2**.

The fuser roller pair 15 heats and presses the paper P1 or P2, on which the toner image is transferred. As a result, the toner image is fixed on the paper P1 or P2.

According to the aforementioned structure, the MFP 1-1 is capable of forming a full-color image on the paper P1 or P2 on a basis of image data (described below).

Figure 3:
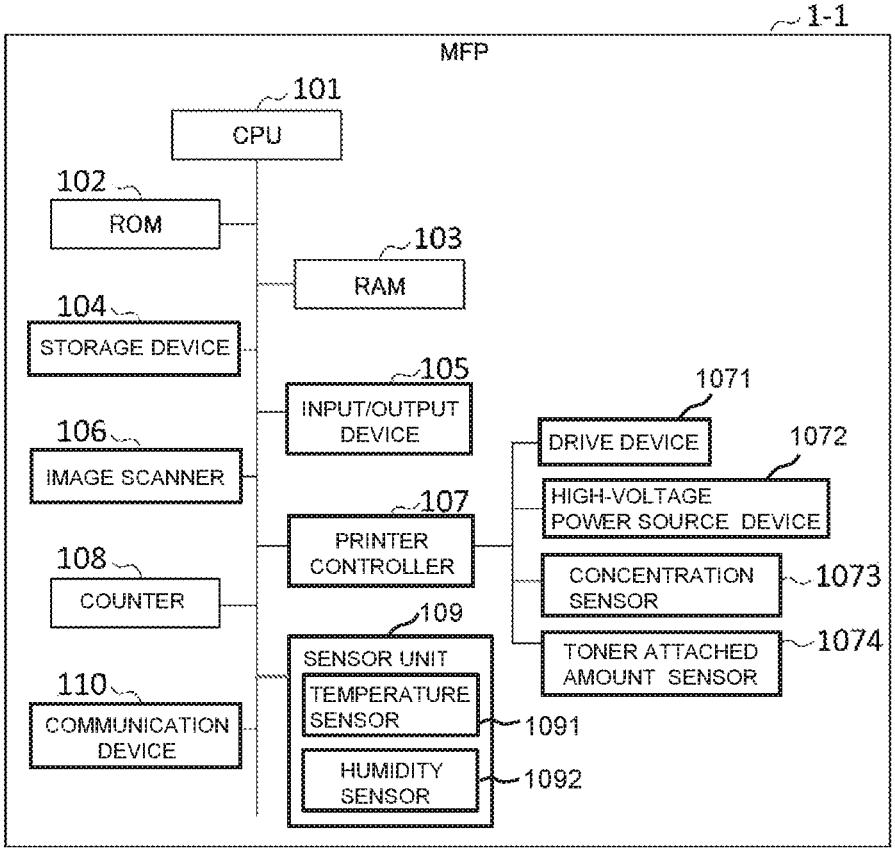
FIG. 3 is a block diagram showing the MFP according to the present embodiment.

FIG. 3 is a block diagram showing the MFP 1-1. The MFP 1-1 includes the CPU (Central Processing Unit) 101, the ROM (Read Only Memory) 102, the RAM (Random Access Memory) 103, the storage device 104, the input/output device 105, the image scanner 106, the printer controller 107, the communication device 110, the driver device 1071, the high-voltage power source device 1072, the concentration sensor 1073, and the toner attached amount sensor 1074. Further, the MFP 1-1 includes a first sensor configured to detect a value about physical property of a component or a consumable item that the MFP 1-1 has, which changes depending on a use status, and output a first detected value (described below). For example, the MFP 1-1 includes a sensor circuit in the high-voltage power source device 1072 as the first sensor. Further, the MFP 1-1 includes a second sensor configured to detect a value about use of the component or the consumable item that the MFP 1-1 has, and output a second detected value (described below). For example, the MFP 1-1 includes the counter 108 and the sensor unit 109 as the second sensors.

The CPU 101 executes programs stored in the ROM 102 or the storage device 104 to thereby control operations of the MFP 1-1 and execute various processing. The CPU 101 is an example of a processor. The CPU 101 is an example of a processing unit that executes various processing.

The ROM 102 stores various programs and data. The RAM 103 temporarily stores various programs. Further, the RAM 103 stores data necessary to execute the programs and execution results.

The storage device 104 stores various programs and data. For example, the storage device 104 includes an HDD (Hard Disk Drive) or an SSD (Solid State Drive).

The input/output device 105 receives operations input by a user, and displays various information. For example, the input/output device 105 is a touch panel including a liquid crystal display and a touchpad layered on the liquid crystal display, but is not limited to a touch panel. The input/output device 105 is a part of a display unit.

The image scanner 106 reads a document, and captures image data on a basis of the document. The image scanner 106 stores the captured image data in the storage device 104. For example, the image scanner 106 includes an image sensor and the like. The image sensor is an image pickup device including linearly-arrayed pixels that convert light to electric signals (image signals). For example, the image sensor includes a CCD (Charge Coupled Device), a CMOS (Complementary Metal Oxide Semiconductor), or another image pickup device.

The printer controller 107 controls devices relating to image forming. For example, the printer controller 107 controls the driver device 1071, the high-voltage power source device 1072, the concentration sensor 1073, and the toner attached amount sensor 1074. Note that the printer controller 107 controls devices relating to image forming other than the devices mentioned above as examples, such as a fusing heater used for fusing the aforementioned toner image.

The driver device 1071 drives devices relating to image forming. For example, the driver device 1071 includes a motor. For example, the driver device 1071 drive the image forming units 11-Y, 11-M, 11-C, and 11-K, the transfer belt 12, the secondary transfer roller pair 14, and the fuser roller pair 15.

The high-voltage power source device 1072 includes a plurality of transformer circuits that applies bias voltages to devices relating to image forming. For example, the high-voltage power source device 1072 applies a bias voltage to the secondary transfer roller pair 14. For example, the high-voltage power source device 1072 applies bias voltages to the primary transfer rollers 114-Y, 114-M, 114-C, and 114-K. For example, the high-voltage power source device 1072 applies bias voltages to the chargers 112-Y, 112-M, 112-C, and 112-K. For example, the high-voltage power source device 1072 applies bias voltages to the developers 113-Y, 113-M, 113-C, and 113-K.

The concentration sensor 1073 is a sensor that detects a toner concentration of a developing agent included in each of the developers 113-Y, 113-M, 113-C, and 113-K. For example, the concentration sensor 1073 is a magnetic sensor, but may be an optical sensor.

The toner attached amount sensor 1074 detects a toner attached amount of the transfer belt 12 on a basis of a toner image transferred to the transfer belt 12. For example, the toner attached amount sensor 1074 is an optical sensor. For example, the toner attached amount sensor 1074 optically detects a toner attached amount on a basis of a pattern of the toner image.

The counter 108 counts values relating to operations of the MFP 1-1. For example, the counter 108 includes a circuit. The values that the counter 108 counts may also be referred to as counter values. For example, the counter values include the number of printed sheets, driving rotation numbers of the secondary transfer roller pair 14 and the like, or driving time periods of the secondary transfer roller pair 14 and the like. However, the counter values are not limited to them. The storage device 104 stores the counter values.

The sensor unit 109 a plurality of sensors that detects values relating to the external environment around the MFP 1-1. For example, the sensor unit 109 includes the temperature sensor 1091 and the humidity sensor 1092. The temperature sensor 1091 detects a temperature (atmosphere temperature) (degrees centigrade). The humidity sensor 1092 detects a relative humidity (% RH). Note that the sensor unit 109 may include various sensors that detect value about an external environment such as a pressure (hPa) other than a temperature (atmosphere temperature) (degrees centigrade) and a relative humidity (% RH). The storage device 104 stores the aforementioned temperature detected value and the aforementioned humidity detected value.

The communication device 110 is an interface, with which the MFP 1-1 communicates with the server 2 via a network. The communication device 110 may include a wired communication interface or may include a wireless communication interface. The communication device 110 is an example of a sending unit that sends information to the server 2. The communication device 110 is an example of a receiving unit that receives information from the server 2.

A configuration of the server 2 will be described. The server 2 derives a formula used to determine whether or not there is a failure relating to the component or the consumable item that each of the MFPs 1-1 to **1-*n* has, or used to determine a lifetime of the component or the consumable item. The formula will be described below. The server 2** is an example of the information processing apparatus.

Figure 4:
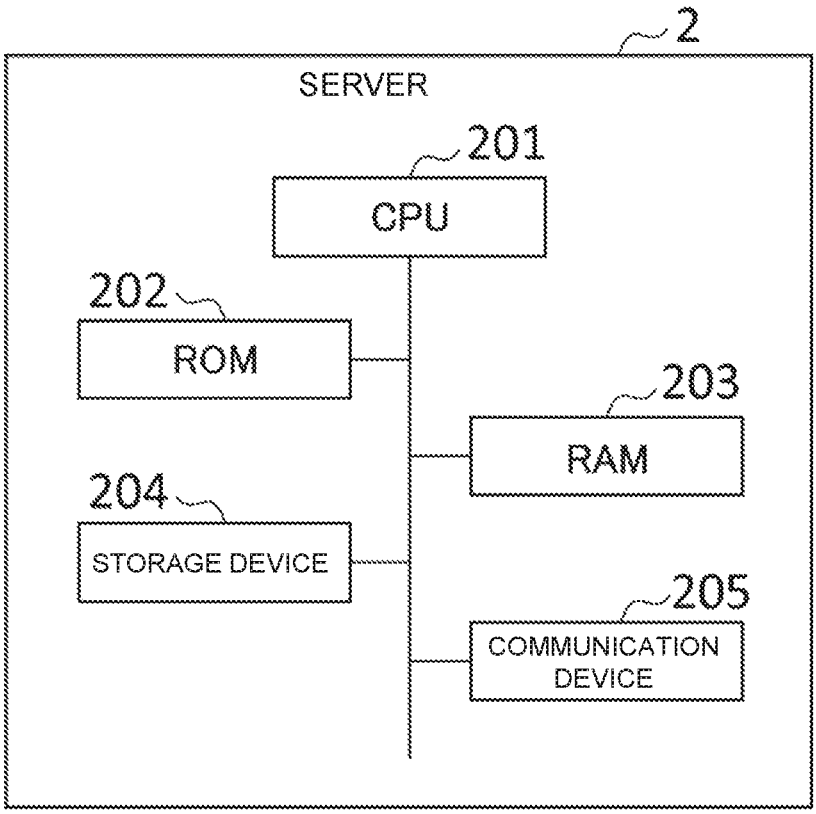
FIG. 4 is a block diagram showing an example of a server according to the present embodiment.

FIG. 4 is a block diagram showing an example of the server 2. The server 2 includes the CPU 201, the ROM 202, the RAM 203, the storage device 204, and the communication device 205.

The CPU 201 executes programs stored in the ROM 202 or the storage device 204 to thereby control operations of the server 2 and execute various processing. The CPU 201 is an example of a processor. The CPU 201 is an example of a calculating unit that derives a formula (described below). The CPU 201 an example of a processing unit that executes various processing.

The ROM 202 stores various programs and data. The RAM 203 temporarily stores various programs. Further, the RAM 203 stores data necessary to execute the programs and execution results.

The storage device 204 stores various programs and data. For example, the storage device 204 includes an HDD or an SSD. The storage device 204 stores information received by the server 2 from the MFPs 1-1 to **1-*n***.

The communication device 205 is an interface, with which the server 2 communicates with the MFPs 1-1 to **1-*n* via a network. The communication device 205 may include a wired communication interface or may include a wireless communication interface. The communication device 205 is an example of a sending unit that sends information to the MFPs 1-1 to 1-*n*. The communication device 205 is an example of a receiving unit that receives information from the MFPs 1-1 to 1-*n***.

Next, the information that the MFP 1-1 sends to the server 2 will be described. Note that the information that the MFPs 1-2 to **1-*n* send to the server 2 is similar to the information that the MFP 1-1 sends to the server 2**. So the description thereof will be omitted.

The MFP 1-1 sends information to the server 2 in response to an information request signal from the server 2. The information request signal includes a request to send information indicating a detected value about a certain component or consumable item. The component or consumable item is required to be replaced depending on the use status. For example, the component is the secondary transfer roller pair 14, but is not limited to that. The component may be the photosensitive drum 111-Y, the primary transfer roller 114-Y, or the like. Instead of those components, the component may be each of various components that the MFP 1-1 has. For example, the consumable item is toner, but is not limited to that. The consumable item may be each of various consumable items that the MFP 1-1 has. For example, the information request signal includes a request to send a detected value about the secondary transfer roller pair 14.

In response to the information request signal from the server 2, the CPU 101 obtains a first detected value about a component or a consumable item specified in the information request signal. An example thereof will be described below. The CPU 101 is an example of a first obtaining unit that obtains a first detected value.

The first detected value is a value detected by the MFP 1-1, and is a value about physical property of a component or a consumable item that the MFP 1-1 itself has. The physical property is a property that changes depending on a use status of the component or the consumable item. For example, the physical property is an electric property, a magnetic property, or an optical property, but is not limited to that. For example, the electric property may be physical property of the secondary transfer roller pair 14. For example, the magnetic property may be physical property of developer. For example, a toner concentration of developer is physical property magnetically detected by the concentration sensor 1073. For example, the optical property may be physical property of toner. A toner attached amount is optically detected by the toner attached amount sensor 1074, and indirectly indicates a charging amount property of toner. The charging amount property of toner is an example of physical property of toner.

The CPU 101 obtains a first detected value by using the respective units of the MFP 1-1, and a method of obtaining the first detected value is not limited. Note that the first detected value may include detected values about a plurality of different physical properties about a component or a consumable item that the MFP 1-1 itself has.

For example, as described in an example below, the CPU 101 obtains a common logarithm value (Log Ω) of an electric resistance of the secondary transfer roller pair 14 detected by the MFP 1-1. A common logarithm value of an electric resistance is physical property. Hereinafter, a common logarithm value of an electric resistance will be simply referred to as an electric resistance value. The electric resistance value of the secondary transfer roller pair 14 detected by the MFP 1-1 will be also referred to as a resistance detected value of the secondary transfer roller pair 14. In response to an information request signal from the server 2, the CPU 101 controls the high-voltage power source device 1072 to supply a constant current to a secondary transferring unit including the secondary transfer roller pair 14. The CPU 101 detects a voltage value of a secondary transferring unit by using a sensor circuit included in the high-voltage power source device 1072. Accordingly the CPU 101 is capable of calculating the electric resistance value of the secondary transferring unit as the resistance detected value of the secondary transfer roller pair 14. The calculated resistance detected value is the storage device 104.

As described in an example below, in response to an information request signal from the server 2, the CPU 101 obtains a second detected value about a component or a consumable item specified in an information request signal. The CPU 101 is an example of a second obtaining unit that obtains a second detected value.

The second detected value is a value detected by the MFP 1-1, and is a value about use of a component or a consumable item that the MFP 1-1 itself has. The value about use is a value indicating how a component or a consumable item is used (use mode).

The second detected value includes a detected value about a use history. A detected value about a use history is a value detected by the MFP 1-1, and a value indicating a use amount of a component or a consumable item. For example, a detected value about a use history is a counter value of the counter 108. A counter value is an example of the detected value.

In response to an information request signal from the server 2, the CPU 101 obtains a detected value about a use history about a component or a consumable item specified in the information request signal from the storage device 104. For example, in response to the information request signal from the server 2, the CPU 101 is capable of obtaining a counter value of a driving rotation number of the secondary transfer roller pair 14 from the storage device 104.

The second detected value may include a detected value about a use environment. A detected value about a use environment is a value detected by the MFP 1-1, and is a value indicating an external environment of a component or a consumable item used. For example, a detected value about a use environment includes at least one detected value of a temperature (atmosphere temperature) (degrees centigrade), a relative humidity (% RH), a pressure (hPa), and the like. However, a detected value about a use environment is not limited to that. A relative humidity will also simply be referred to as a humidity.

In response to the information request signal from the server 2, the CPU 101 obtains a detected value about a use environment. For example, in response to the information request signal from the server 2, the CPU 101 is capable of obtaining a detected value of a temperature by using the temperature sensor 1091. In response to the information request signal from the server 2, the CPU 101 is capable of obtaining a detected value of a humidity by using the humidity sensor 1092.

Note that a detected value of physical property varies depending on not only a use history of a component or a consumable item but also a use environment. Accordingly a detected value about use preferably includes a detected value about a use environment, in addition to a detected value about a use history.

The communication device 110 sends information indicating a first detected value and information indicating a second detected value to the server 2 being an external apparatus. The information indicating a first detected value will be also referred to as first detected value information. The information indicating a second detected value will be also referred to as second detected value information.

Next, how the server 2 collects information from the MFPs 1-1 to **1-*n* will be described. Hereinafter, the server 2 collects first detected value information and second detected value information of the secondary transfer roller pair from each of the MFPs 1-1 to 1-100**, the number of MFPs being 100. In an example described hereinafter, the secondary transfer roller pair is an example of a component or a consumable item. Accordingly the "secondary transfer roller pair" in the following description is exchangeable for "a component or a consumable item" as necessary.

The communication device 205 sends an information request signal to each of the MFPs 1-1 to 1-100. The information request signal includes a request for a first detected value of the secondary transfer roller pair 14. The first detected value of the secondary transfer roller pair 14 includes a resistance detected value of the secondary transfer roller pair 14. The information request signal includes a request for a second detected value of the secondary transfer roller pair 14. The second detected value of the secondary transfer roller pair 14 includes a driving rotation number of the secondary transfer roller pair 14, a temperature, and a humidity.

As a response for the information request signal, the communication device 205 receives first detected value information and second detected value information of the secondary transfer roller pair that each of the MFPs 1-1 to 1-100 has from each of the MFPs 1-1 to 1-100. The first detected value information includes information indicating a resistance detected value of the secondary transfer roller pair. The second detected value information includes information indicating a driving rotation number of the secondary transfer roller pair, information indicating a temperature, and information indicating a humidity.

The CPU 201 stores the first detected value information and the second detected value information of the secondary transfer roller pair received from each of the MFPs 1-1 to 1-100 in the storage device 204. As described above, the server 2 is capable of collecting the first detected value information and the second detected value information of the same kind of certain component or consumable item from each of the MFPs 1-1 to 1-100.

FIG. 5 shows an example of the storage device 204 that stores information collected by the server 2. In FIG. 5, the "machine 1" to the "machine 100" correspond to the MFPs 1-1 to 1-100, respectively. $X_1$ indicates a detected value of a temperature included in the second detected value. $X_2$ indicates a detected value of a humidity included in the second detected value. $X_3$ indicates a counter value of a driving rotation number of the secondary transfer roller pair included in the second detected value. Y indicates a resistance detected value of the secondary transfer roller pair included in the first detected value. In short, the CPU 201 stores the first detected value information (Y) and the second detected value information (X, $X_2$, and $X_3$) in the storage device 204 for each of the MFPs 1-1 to 1-100 (machines 1 to 100).

Note that the server 2 is capable of arbitrarily selecting target MFPs from which information is collected. For example, the server 2 may select MFPs distributed in various areas. In this example, by selecting MFPs used in various conditions, the server 2 is capable of obtaining use tendencies of statistically appropriate MFPs. The server 2 may select MFPs provided in a predetermined region such as an office, for example. In this example, by selecting MFPs used in a certain common condition, the server 2 is capable of obtaining use tendencies of MFPs used in the certain condition. Note that the server 2 may be capable of arbitrarily changing the number of target MFPs from which information is collected.

Next, how the server 2 derives a formula defining a relationship between a value about use of the secondary transfer roller pair and a value about physical property of the secondary transfer roller pair will be described. As described in an example below, the CPU 201 derives a formula on a basis of first detected value information and second detected value information about each of the MFPs 1-1 to 1-100.

For example, the CPU 201 derives the following Formula (1) defining a relationship between a temperature, a humidity, and a driving rotation number of the secondary transfer roller pair, and an electric resistance value of the secondary transfer roller pair by using information stored in the storage device 204 of FIG. 5. Formula (1) indicates an average behavior of a large majority of secondary transfer roller pairs.

Formula (1) is a multiple linear regression formula. The multiple linear regression formula is an example of a formula. The formula is not limited to the multiple linear regression formula. Note that the CPU 201 may derive the aforementioned formula by using information about a plurality of MFPs arbitrarily selected from information about all the MFPs 1-1 to 1-100 (machines 1 to 100) stored in the storage device 204. For example, the CPU 201 may select MFPs used in a predetermined condition (temperature $X_1$ or humidity $X_2$) range, for example, to derive the aforementioned formula.

$$Y'=8.658-0.03744X_1-0.005442X_2+4.805\times10^{-8}X_3 \qquad \text{Formula (1)}$$

Y' indicates an electric resistance value (Log Ω) of the secondary transfer roller pair. Y' is an example of a value about physical property of the secondary transfer roller pair.

$X_1$ indicates a temperature (degrees centigrade).

$X_2$ indicates a humidity (% RH).

$X_3$ indicates a driving rotation number of the secondary transfer roller pair 14.

Each of $X_1$, $X_2$, and $X_3$ is an example of a value about use of the secondary transfer roller pair 14.

The CPU 201 is capable of applying the temperature detected value, the humidity detected value, and the counter value of the driving rotation number of the secondary transfer roller pair, which are included in the second detected value (see FIG. 5) stored in the storage device 204, to $X_1$, $X_2$, and $X_3$ of Formula (1). As a result, the CPU 201 is capable of calculating Y'. Y' is an electric resistance value of the secondary transfer roller pair 14 estimated on a basis of the second detected value. The electric resistance value of the secondary transfer roller pair 14 estimated on a basis of the second detected value will be also referred to as a resistance estimated value of the secondary transfer roller pair 14.

Figure 6:
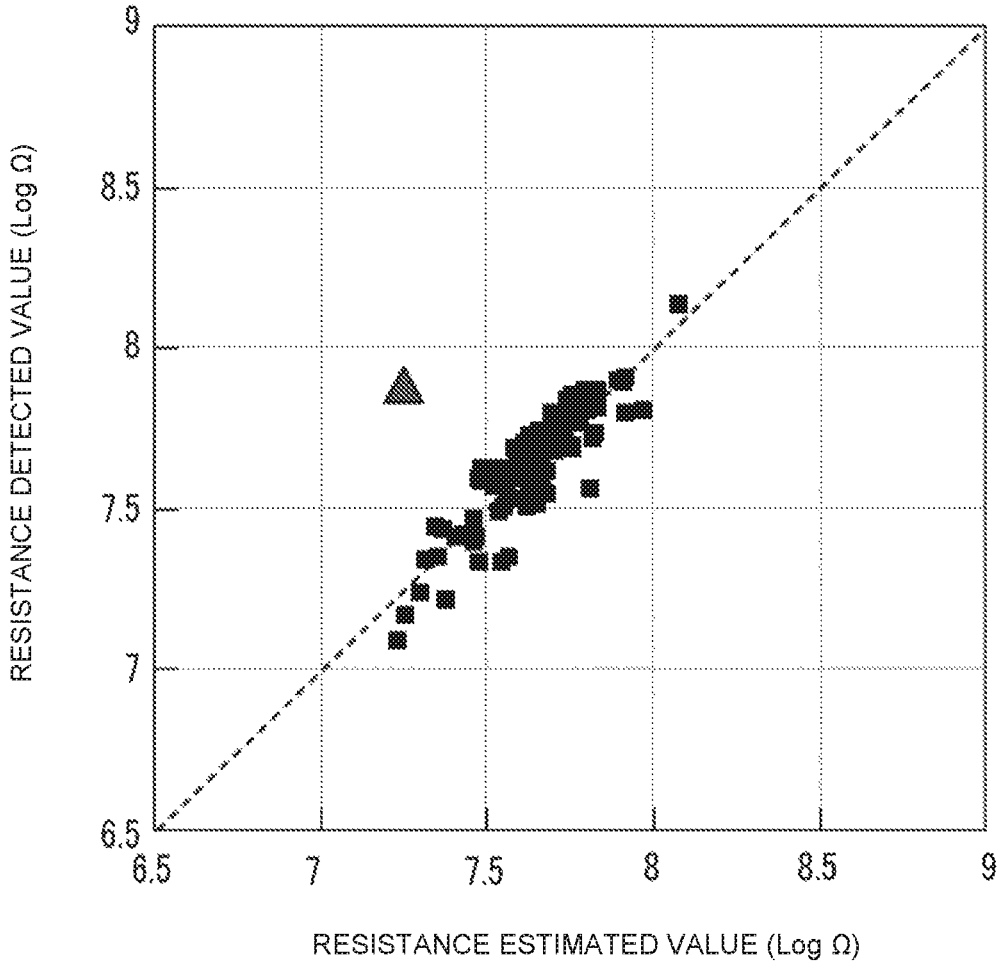
FIG. 6 is a diagram showing an example of a relationship between a resistance estimated value and a resistance detected value of a secondary transfer roller pair according to the present embodiment.

FIG. 6 is a diagram showing an example of a relationship between a resistance estimated value and a resistance detected value. FIG. 6 is a plot data graph showing a relationship between a resistance estimated value and a resistance detected value of the secondary transfer roller pair 14 of each of the MFPs 1-1 to 1-100. The horizontal axis shows resistance estimated values, and the vertical axis shows resistance detected values. The dotted straight line shows a linear function in which a resistance estimated value is the same as a resistance detected value.

There are a large number of plot data items indicated by square dots. The plot data items indicated by square dots are close to the dotted straight line. It is understood that a resistance estimated value of the secondary transfer roller pair 14, which actually operates in a normal situation, is approximately the same as a resistance detected value thereof. It is understood that an electric resistance value of the secondary transfer roller pair 14 of an MFP relating to a plot data item close to the dotted straight line is shifted normally in a normal operational situation while the secondary transfer roller pair 14 is affected by an environment or a lifespan. Accordingly it is effective to use Formula (1) to estimate an electric resistance value of an actual secondary transfer roller pair operating in a normal situation. Note that, in Formula (1), the coefficient of determination (also referred to as $R^2$) value is 0.79.

Meanwhile, there is a small number of a plot data item indicated by a triangle dot. The plot data item indicated by a triangle dot is largely distant from the dotted straight line. It is understood that there is a high possibility of occurrence of a failure relating to the secondary transfer roller pair of an MFP relating to a plot data item indicated by the triangle dot.

Next, an example of how the server 2 determines whether or not there is a failure relating to the secondary transfer roller pair will be described. The server 2 determines whether or not there is a failure relating to the secondary transfer roller pair for each of the MFPs 1-1 to 1-100. Here, an example of how the server 2 determines whether or not there is a failure relating to the secondary transfer roller pair of an arbitrary MFP included in the MFPs 1-1 to 1-100 will be described. An arbitrary MFP will be also referred to as a target MFP. Here, the target MFP is the MFP 1-1.

Firstly, as described in an example below, the CPU 201 compares the resistance detected value of the secondary transfer roller pair that the MFP 1-1 has with the resistance estimated value of the secondary transfer roller pair 14 that the MFP 1-1 has. Here, the CPU 201 obtains the second detected value information of the secondary transfer roller pair 14 that the MFP 1-1 has from the storage device 204. The CPU 201 applies the temperature detected value, the humidity detected value, and the counter value of the driving rotation number of the secondary transfer roller pair 14, which are included in the second detected value (see FIG. 5), to $X_1$, $X_2$, and $X_3$ of Formula (1). Accordingly the CPU 201 is capable of calculating Y', i.e., the resistance estimated value of the secondary transfer roller pair 14.

Figure 7:
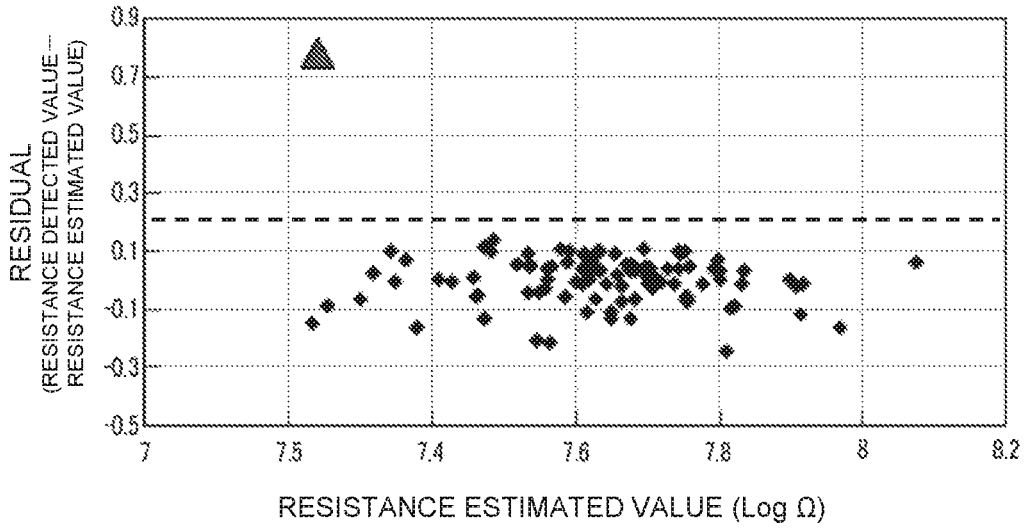
FIG. 7 is a diagram showing an example of a relationship between a resistance estimated value of the secondary transfer roller pair 14 and a first residual according to the present embodiment.

The CPU 201 obtains the first detected value information of the secondary transfer roller pair 14 that the MFP 1-1 has from the storage device 204. The CPU 201 refers to information indicating the resistance detected value of the secondary transfer roller pair 14 included in the first detected value information. The CPU 201 compares the resistance detected value with the resistance estimated value. The CPU 201 subtracts the resistance estimated value from the resistance detected value to thereby calculate a first residual. The first residual is an example of a comparison result between the resistance detected value and the resistance estimated value. FIG. 7 is a diagram showing an example of a relationship between the aforementioned first residual and a resistance estimated value. FIG. 7 is a plot data graph showing, for example, a relationship between a first residual and a resistance estimated value of the secondary transfer roller pair 14 of each of the MFPs 1-1 to 1-100. The horizontal axis shows a resistance estimated value, and the vertical axis shows a first residual.

Next, as described in an example below, the CPU 201 determines whether or not there is a failure relating to the secondary transfer roller pair 14 that the MFP 1-1 has on a basis of the comparison result between the resistance detected value and the resistance estimated value. Here, the CPU 201 compares the first residual with a predetermined first criterion value. The first criterion value may be determined arbitrarily. For example, a first criterion value shown by the dotted line of FIG. 7 is determined.

If the absolute value of the first residual is equal to or smaller than the first criterion value (see plot data items indicated by diamond dots of FIG. 7), it is understood that the resistance detected value is the same as or approximately the same as the resistance estimated value. The CPU 201 determines that the electric resistance value of the secondary transfer roller pair 14 is shifted normally. Accordingly the CPU 201 determines that there is no failure relating to the secondary transfer roller pair 14 on a basis of the comparison result indicating that the first residual is equal to or smaller than the first criterion value. The determination result indicating that there is no failure relating to the secondary transfer roller pair 14 will be also referred to as a first determination result. The first determination result is an example of a determination result indicating whether or not there is a failure.

Meanwhile, if the absolute value of the first residual exceeds the first criterion value (see plot data item indicated by a triangle dot of FIG. 7), it is understood that the resistance detected value is largely distant from the resistance estimated value. The CPU 201 determines that the electric resistance value of the secondary transfer roller pair 14 is not shifted normally. Accordingly the CPU 201 determines that there is a failure relating to the secondary transfer roller pair 14 on a basis of the comparison result indicating that the first residual exceeds the first criterion value. The determination result indicating that there is a failure relating to the secondary transfer roller pair 14 will be also referred to as a second determination result. The second determination result is an example of a determination result indicating whether or not there is a failure.

Note that a failure relating to the secondary transfer roller pair 14 includes not only a failure of the secondary transfer roller pair 14 itself but also a failure of a component relating to the secondary transfer roller pair 14. The reason is as follows. The absolute value of the first residual exceeds the first criterion value not only when the secondary transfer roller pair 14 itself has a failure but also when a component relating to the secondary transfer roller pair 14 has a failure. Examples of the component relating to the secondary transfer roller pair 14 include a bearing of the secondary transfer roller pair 14 and a power source of the secondary transfer roller pair. However, the component is not limited to those examples.

According to the present embodiment, the server 2 is capable of providing a formula, with which it is possible to appropriately determine whether or not there is a failure relating to a component or a consumable item. The server 2 appropriately determines whether or not there is a failure relating to a component or a consumable item by using the aforementioned formula, and is thereby capable of appropriately acquiring a status of a component or a consumable item.

The server 2 may assist as described in the following example depending on the determination whether or not there is a failure relating to the secondary transfer roller pair 14.

For example, the communication device 205 of the server 2 sends information indicating the first determination result or information indicating the second determination result to the MFP 1-1. The information indicating the first determination result will be also referred to as first determination result information. The information indicating the second determination result will be also referred to as second determination result information. The communication device 110 of the MFP 1-1 receives the first determination result information or the second determination result information from the server 2. Controlled by the CPU 101, the input/output device 105 displays information about a failure in response to the first determination result information or the second determination result information. For example, the input/output device 105 displays, depending on the second determination result information, an alert message indicating occurrence of a failure relating to the secondary transfer roller pair 14. A user is thereby capable of confirming the alert message and handling the failure promptly and appropriately.

For example, the communication device 205 of the server 2 sends an operation stop request signal to the MFP 1-1 in response to the second determination result. The operation stop request signal includes a request to stop the operation of the MFP 1-1. The communication device 110 of the MFP 1-1 receives the operation stop request signal from the server 2. In response to the operation stop request signal, the CPU 101 stops the operation of at least the component relating to the secondary transfer roller pair 14. As a result, it is possible to prevent the MFP 1-1 from being used in an abnormal state.

For example, in response to the second determination result, the communication device 205 of the server 2 sends the second determination result information to a service center. As a result, a service person is capable of promptly and appropriately handling the failure of the MFP 1-1.

As described above, the server 2 appropriately determines whether or not there is a failure relating to a component or a consumable item, and is thereby capable of appropriately assisting in preventing the MFP from being used in the abnormal state after that. As a result, the MFP's downtime loss will be reduced.

Next, an example of how the server 2 determines a lifetime of the secondary transfer roller pair will be described. Here, an example of how the server 2 determines a lifetime of the secondary transfer roller pair of an arbitrary MFP included in the MFPs 1-1 to 1-100 will be described. In a typical example, the server 2 determines a lifetime of the secondary transfer roller pair depending on a determination result indicating that there is a failure relating to the secondary transfer roller pair. The arbitrary MFP will be also referred to as a target MFP. Here, the target MFP is the MFP 1-1.

As described in an example below, the CPU 201 determines a lifetime of the secondary transfer roller pair 14 on a basis of the maximum value of the driving rotation number of the secondary transfer roller pair 14 that the MFP 1-1 has calculated by using Formula (1). Here, the CPU 201 obtains a threshold value about an electric resistance value associated with the lifetime of the secondary transfer roller pair 14 that the MFP 1-1 has from the storage device 204. The lifetime means a useful time period from a use start time point to a replacement required time point of a component or a consumable item in a normal operational situation. The threshold value about an electric resistance value is a value about physical property, and is a maximum value in the normal operational situation.

The CPU 201 applies the temperature detected value, the humidity detected value included in the second detected value, and the threshold value of the electric resistance value to $X_1$, $X_2$, and Y' of Formula (1). As a result, the CPU 201 is capable of calculating $X_3$, i.e., the maximum value of the driving rotation number of the secondary transfer roller pair 14. The maximum value of the driving rotation number is an example of a value about use. The maximum value of the driving rotation number is a value indicating an approximate driving number of the secondary transfer roller pair 14 that reaches the upper limit of the resistance value. The CPU 201 determines the maximum value of the driving rotation number of the secondary transfer roller pair 14 as a lifetime of the secondary transfer roller pair 14 that the MFP 1-1 has.

Note that, as apparent from Formula (1), the higher the temperature and the humidity, the lower Y'. Therefore it is expected that the maximum value of the driving rotation number until the secondary transfer roller pair 14 reaches the end of the lifetime in a high temperature and high humidity environment is larger than the maximum value of the driving rotation number until the secondary transfer roller pair 14 reaches the end of the lifetime in a low temperature and low humidity environment. In this manner, it is sometimes difficult for the server 2 to determine whether an electric resistance value is high because of the lifetime or affected by a use environment only on a basis of a resistance detected value. Since the server 2 derives Formula (1) also based on a temperature and a humidity, the server 2 is capable of appropriately predicting a lifetime depending on a use environment of an MFP.

As described in an example below, the CPU 201 may determine a lifetime approaching level of the secondary transfer roller pair 14, which is approaching the end of the lifetime. Here, the CPU 201 obtains the counter value of the driving rotation number of the secondary transfer roller pair 14 that the MFP 1-1 has from the storage device 204 (see FIG. 5). The CPU 201 subtracts the driving rotation number counter value from the driving rotation number maximum value to thereby calculate a second residual. The second residual is an example of a comparison result of comparison between the driving rotation number maximum value and the driving rotation number counter value. The CPU 201 compares the second residual with a predetermined second criterion value. The second criterion value may be set arbitrarily.

If the second residual is equal to or smaller than the second criterion value, then it means that the driving rotation number counter value is the same as or approximately the same as the driving rotation number maximum value. So the CPU 201 determines that the secondary transfer roller pair 14 is approaching the end of the lifetime on a basis of the comparison result, which indicates that the second residual is equal to or smaller than the second criterion value. The determination result, which indicates that the secondary transfer roller pair 14 is approaching the end of the lifetime, will be also referred to as a third determination result. The third determination result is an example of a determination result indicating a lifetime.

Meanwhile, if the second residual exceeds the second criterion value, then it means that the driving rotation number counter value is largely distant from the driving rotation number maximum value. So the CPU 201 determines that the secondary transfer roller pair 14 is not approaching the end of the lifetime on a basis of the comparison result, which indicates that the second residual exceeds the second criterion value. The determination result, which indicates that the secondary transfer roller pair 14 is not approaching the end of the lifetime, will be also referred to as a fourth determination result. The fourth determination result is an example of a determination result indicating a lifetime.

According to the present embodiment, the server 2 is capable of providing a formula, with which it is possible to appropriately determine a lifetime of a component or a consumable item. The server 2 appropriately determines a lifetime of a component or a consumable item by using the aforementioned formula, and is thereby capable of appropriately acquiring the status of the component or the consumable item.

The server 2 may assist as described in the following example depending on the determination of the lifetime of the secondary transfer roller pair 14.

For example, the communication device 205 of the server 2 sends information indicating the third determination result or information indicating the fourth determination result to the MFP 1-1. The information indicating the third determination result will be also referred to as third determination result information. The information indicating the fourth determination result will be also referred to as fourth determination result information. The communication device 110 of the MFP 1-1 receives the third determination result information or the fourth determination result information from the server 2. Controlled by the CPU 101, the input/output device 105 displays information about a lifetime in response to the third determination result information or the fourth determination result information. For example, the input/output device 105 displays, depending on the third determination result information, an alert message indicating the secondary transfer roller pair 14 is approaching the end of the lifetime. A user is thereby capable of confirming the alert message and handling the lifetime of the secondary transfer roller pair 14 promptly and appropriately.

In response to the third determination result information received, the CPU 101 is capable of executing life-prolonging actions for the secondary transfer roller pair 14. Examples of the life-prolonging action include an action of reducing a process speed, an action of reducing a transfer bias, an action of temporarily increasing a resistance maximum permissible value, and the like. However, the life-prolonging action is not limited to those examples. As a result, it is possible for the MFP 1-1 to prevent the secondary transfer roller pair 14 from immediately approaching the end of the lifetime when the secondary transfer roller pair 14 is approaching the end of the lifetime.

For example, the communication device 205 of the server 2 may automatically order the secondary transfer roller pair in response to the third determination result. As a result, a user may replace or maintain the secondary transfer roller pair 14 smoothly at appropriate timing.

As described above, the server 2 appropriately determines a lifetime of a component or a consumable item, and is thereby capable of appropriately assisting in preventing the component or the consumable item from approaching the end of the lifetime. As a result, the MFP's downtime loss will be reduced.

Figure 8:
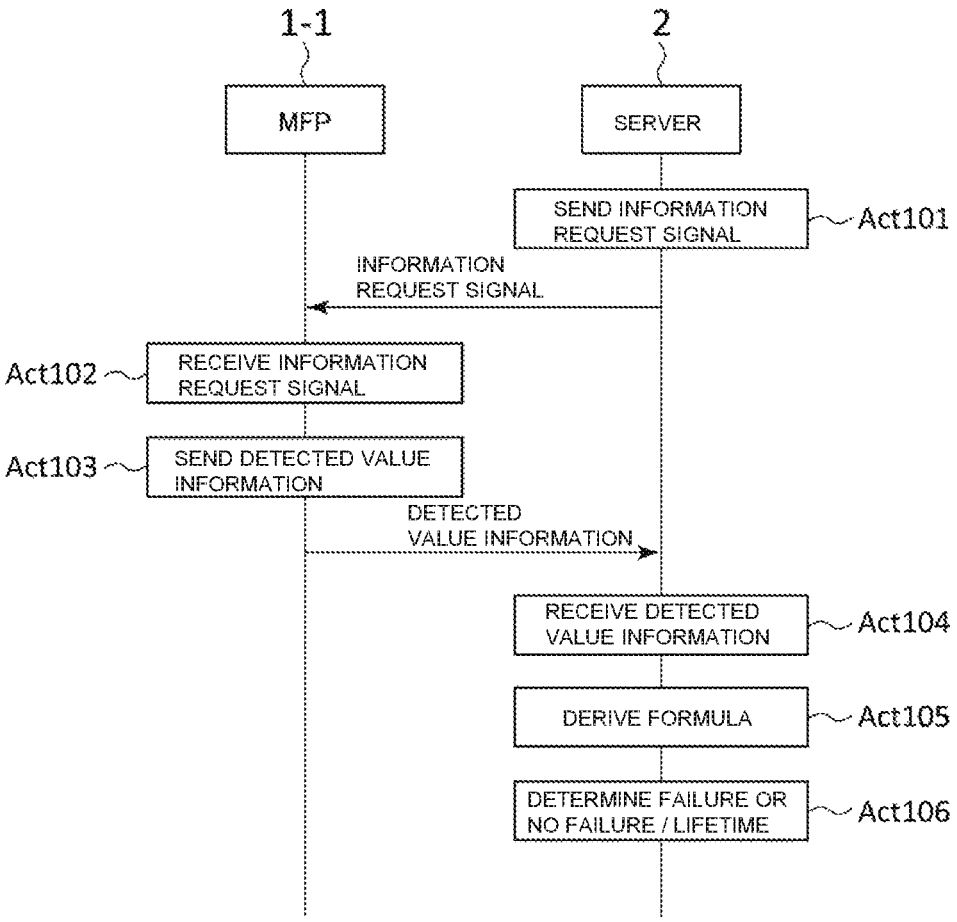
FIG. 8 is a sequential diagram showing an example of processing of the information processing system according to the present embodiment.

Next, an example of a processing flow of the information processing system 100 will be described. FIG. 8 is a sequential diagram showing an example of processing of the information processing system.

In Act 101 of FIG. 8, the CPU 201 of the server 2 sends information request signals to the MFPs 1-1 to 1-100 via the communication device 205.

In Act 102, the CPU 101 of the MFP 1-1 receives the information request signal from the server 2 via the communication device 110. In Act 103, the CPU 101 sends the first detected value information and the second detected value information to the server 2 via the communication device 110.

Next, in Act 104, the CPU 201 of the server 2 receives the first detected value information and the second detected value information of the secondary transfer roller pair 14 that the MFP 1-1 has via the communication device 205. Further, in Act 104, the CPU 201 receives the first detected value information and the second detected value information of the secondary transfer roller pair that each of the MFPs 1-2 to 1-100 has via the communication device 205.

In Act 105, the CPU 201 of the server 2 derives the aforementioned formula (1). In Act 106, as described above, the CPU 201 determines whether or not there is a failure relating to the secondary transfer roller pair that each of the MFPs 1-1 to 1-100 has. Alternatively, the CPU 201 determines the lifetime of the secondary transfer roller pair that each of the MFPs 1-1 to 1-100 has.

Figure 9:
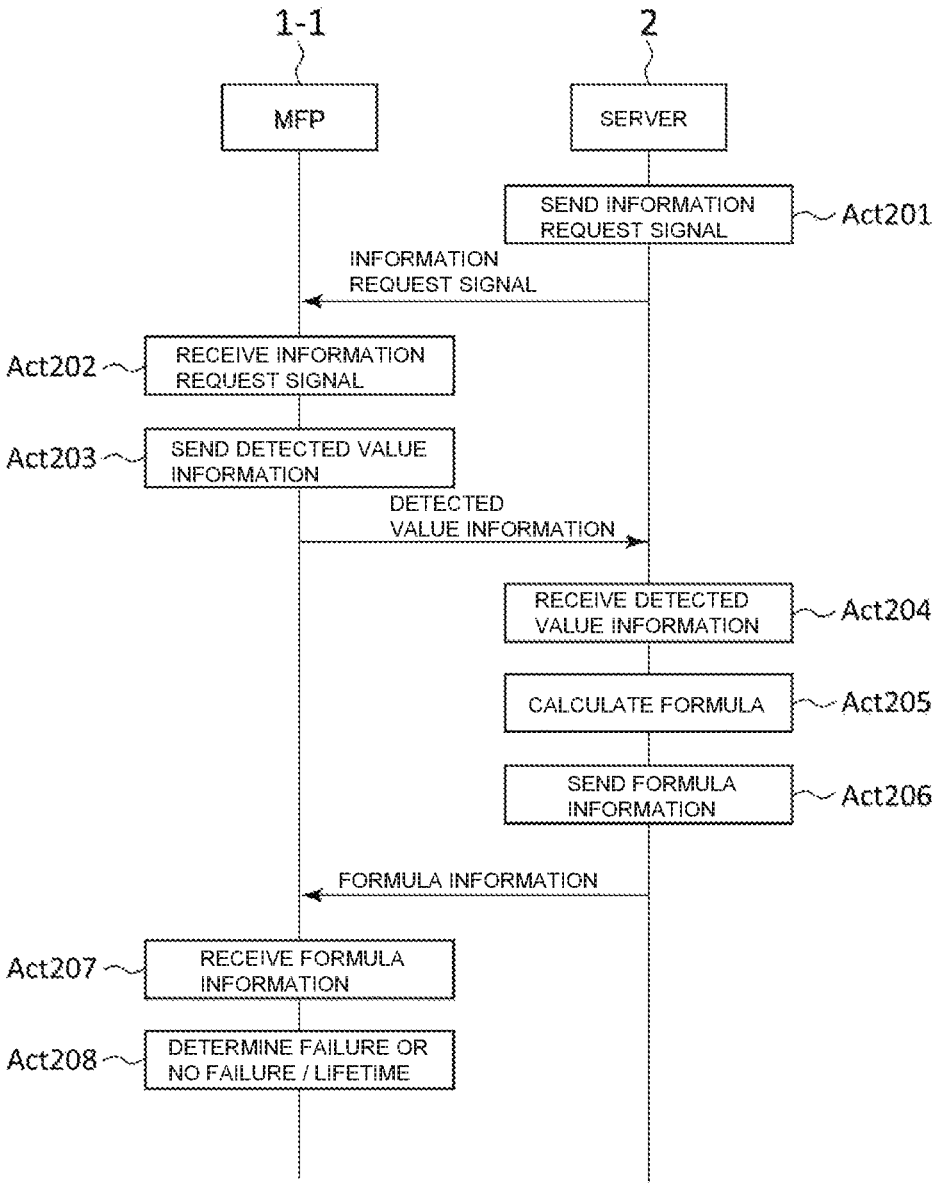
FIG. 9 is a sequential diagram showing another example of processing of the information processing system.

Next, another example of a processing flow of the information processing system 100 will be described. FIG. 9 is a sequential diagram showing another example of processing of the information processing system.

The example of FIG. 9 is different from the example of FIG. 8 in that the MFP 1-1 determines whether or not there is a failure relating to the secondary transfer roller pair 14 or determines the lifetime of the secondary transfer roller pair 14. Note that the processing of Act 201 to Act 205 are similar to the processing of Act 101 to Act 105, and description thereof will be omitted.

In Act 206 of FIG. 9, the CPU 201 of the server 2 sends information indicating Formula (1) to the MFPs 1-1 to 1-100 via the communication device 205. The information indicating Formula (1) will be also referred to as formula information.

Next, in Act 207, the CPU 101 of the MFP 1-1 receives the formula information via the communication device 110. In Act 208, by executing processing similar to the aforementioned processing of the CPU 201 of the server 2, the CPU 101 determines whether or not there is a failure relating to the secondary transfer roller pair 14 or determines the lifetime of the secondary transfer roller pair 14.

In order to determine whether or not there is a failure, for example, the CPU 101 compares the resistance detected value of the secondary transfer roller pair 14 that the MFP 1-1 has with the resistance estimated value of the secondary transfer roller pair 14 that the MFP 1-1 has. The CPU 101 determines whether or not there is a failure relating to the secondary transfer roller pair 14 that the MFP 1-1 has on a basis of the comparison result between the resistance detected value and the resistance estimated value. Similar to the aforementioned server 2, the CPU 101 may assist depending on determination whether or not there is a failure relating to the secondary transfer roller pair 14.

In order to determine the lifetime, the CPU 101 determines the lifetime of the secondary transfer roller pair 14 on a basis of the driving rotation number maximum value of the secondary transfer roller pair 14 that the MFP 1-1 has calculated by using Formula (1). Note that, in this case, the aforementioned threshold value applied to Formula (1) is prestored in the storage device 104, for example. Similar to the aforementioned server 2, the CPU 101 may assist depending on determination of the lifetime of the secondary transfer roller pair 14.

In the aforementioned embodiment, a component or a consumable item that an image forming apparatus such as an MFP has, for example, has been described. However, the present embodiment is not limited to that example. The aforementioned embodiment is applicable to a component or a consumable item that an arbitrary apparatus different from an image forming apparatus has.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A non-transitory computer-readable storage medium storing a program for causing a computer of an information processing apparatus configured to manage information of a plurality of apparatuses which are configured to be connected to the information processing apparatus via a network, to execute processing comprising:

storing a first detected value about a physical property of a component or a consumable item that each of the plurality of apparatuses has, which changes depending on a use status, and a second detected value about use of the component or the consumable item, in a storage device of the information processing apparatus;

collecting the first detected value and the second detected value about each of the plurality of apparatuses via a communication device of the information processing apparatus;

causing the storage device to store the collected first detected value and the collected second detected value for each of the plurality of apparatuses; and deriving a formula on the basis of the stored first detected values and the stored second detected values, the formula defining a relationship between a variable representing the use of the component or the consumable item and a variable representing the physical property of the component or the consumable item.

2. The non-transitory computer-readable storage medium according to claim 1, wherein the executed processing further comprises:

obtaining the second detected value of the component or the consumable item that a target apparatus has from the storage device, the target apparatus being included in the plurality of apparatuses;

applying the obtained second detected value to the formula, and thereby calculating an estimated value about physical property of the component or the consumable item that the target apparatus has;

obtaining the first detected value about the target apparatus from the storage device;

comparing the obtained first detected value with the calculated estimated value; and determining whether or not there is a failure relating to the component or the consumable item that the target apparatus has on the basis of a result of the comparison.

3. The non-transitory computer-readable storage medium according to claim 1, wherein the storing further includes prestoring a threshold value of physical property associated with a lifetime of the component or the consumable item that each of the plurality of apparatuses has, and the executed processing further comprises:

obtaining the threshold value about a target apparatus from the storage device, the target apparatus being included in the plurality of apparatuses;

applying the obtained threshold value to the formula, and thereby calculating a maximum value about use of the component or the consumable item that the target apparatus has; and determining a lifetime of the component or the consumable item that the target apparatus has on the basis of the calculated maximum value.

4. A non-transitory computer-readable storage medium storing a program for causing a computer of an image forming apparatus to execute processing, the image forming apparatus having a component and a consumable item for forming an image and being configured to be connected to an information processing apparatus via a network, the information processing apparatus being configured to collect information from a plurality of image forming apparatuses, the executed processing comprising:

detecting a value about a physical property of the component or the consumable item, which changes depending on a use status, and outputting a first detected value by using a first sensor of the image forming apparatus;

detecting a value about use of the component or the consumable item, and outputting a second detected value by using a second sensor of the image forming apparatus;

storing the first detected value and the second detected value output from the first sensor and the second sensor in a storage device of the image forming apparatus;

obtaining the first detected value and the second detected value from the storage device;

sending the obtained first detected value and the obtained second detected value to the information processing apparatus via a communication device of the image forming apparatus; and receiving information from the information processing apparatus via the communication device, the information including one of:

information indicating a formula derived on the basis of information collected from the plurality of image forming apparatuses, the formula defining a relationship between a variable representing the use of the component or the consumable item and a variable representing the physical property of the component or the consumable item, or information indicating a failure or a lifetime relating to the component or the consumable item determined on the basis of the formula.

5. The non-transitory computer-readable storage medium according to claim 4, wherein the executed processing further comprises:

receiving information indicating the formula from the information processing apparatus via the communication device, and thereby obtaining the formula;

applying the second detected value obtained from the storage device to the formula, and thereby calculating an estimated value about physical property of the component or the consumable item;

comparing the first detected value obtained from the storage device with the calculated estimated value; and determining whether or not there is a failure relating to the component or the consumable item on the basis of a result of the comparison.

6. The non-transitory computer-readable storage medium according to claim 4, wherein the storing further includes prestoring a threshold value of physical property associated with a lifetime of the component or the consumable item, and the executed processing further comprises:

applying the prestored threshold value to the formula, and thereby calculating a maximum value about use of the component or the consumable item; and determining a lifetime of the component or the consumable item on the basis of the calculated maximum value.

7. The non-transitory computer-readable storage medium according to claim 4, wherein the executed processing further comprises:

obtaining information indicating the failure or the lifetime relating to the component or the consumable item via the communication device; and causing a display of the image forming apparatus to display the obtained information indicating the failure or the lifetime.

8. An information processing method of an information processing apparatus configured to manage information of a plurality of apparatuses, the plurality of apparatuses being configured to be connected to the information processing apparatus via a network, the information processing method comprising:

storing a first detected value about a physical property of a component or a consumable item that each of the plurality of apparatuses has, which changes depending on a use status, and a second detected value about use of the component or the consumable item, in a storage device of the information processing apparatus;

collecting the first detected value and the second detected value about each of the plurality of apparatuses via a communication device of the information processing apparatus;

causing the storage device to store the collected first detected value and the collected second detected value for each of the plurality of apparatuses; and deriving a formula on the basis of the stored first detected values and the stored second detected values, the formula defining a relationship between a variable representing the use of the component or the consumable item and a variable representing the physical property of the component or the consumable item.

9. The information processing method according to claim 8, further comprising:

obtaining the second detected value of the component or the consumable item that a target apparatus has from the storage device, the target apparatus being included in the plurality of apparatuses;

applying the obtained second detected value to the formula, and thereby calculating an estimated value about physical property of the component or the consumable item that the target apparatus has;

obtaining the first detected value about the target apparatus from the storage device, comparing the obtained first detected value with the calculated estimated value; and determining whether or not there is a failure relating to the component or the consumable item that the target apparatus has on the basis of a result of the comparison.

10. The information processing method according to claim 8, wherein the storing further includes prestoring a threshold value of physical property associated with a lifetime of the component or the consumable item that each of the plurality of apparatuses has, and the method further comprises:

obtaining the threshold value about a target apparatus from the storage device, the target apparatus being included in the plurality of apparatuses;

applying the obtained threshold value to the formula, and thereby calculating a maximum value about use of the component or the consumable item that the target apparatus has; and determining a lifetime of the component or the consumable item that the target apparatus has on the basis of the calculated maximum value.

* * * * *